US008844510B2

(12) United States Patent
Liu

(10) Patent No.: US 8,844,510 B2
(45) Date of Patent: Sep. 30, 2014

(54) RISER OF COMPOUND BOW

(71) Applicant: Poe Lang Enterprise Co., Ltd., Taichung (TW)

(72) Inventor: Chi-Chang Liu, Taichung (TW)

(73) Assignee: Poe Lang Enterprise Co., Ltd., Taichung (TW)

( * ) Notice: Subject to any disclaimer, the term of this patent is extended or adjusted under 35 U.S.C. 154(b) by 86 days.

(21) Appl. No.: 13/671,885

(22) Filed: Nov. 8, 2012

(65) Prior Publication Data

US 2014/0123971 A1 May 8, 2014

(51) Int. Cl.
*F41B 5/00* (2006.01)
*F41B 5/14* (2006.01)
*F41B 5/10* (2006.01)

(52) U.S. Cl.
CPC ... *F41B 5/10* (2013.01); *F41B 5/00* (2013.01); *F41B 5/0031* (2013.01); *F41B 5/14* (2013.01)
USPC ..... 124/88; 124/23.1; 124/25.6; 124/86

(58) Field of Classification Search
CPC ..... F41B 5/00; F41B 5/14
USPC ..... 124/23.1, 25.6, 86, 88
See application file for complete search history.

(56) References Cited

U.S. PATENT DOCUMENTS 2,514,638 A * 7/1950 Grenier ..... 124/23.1
3,055,353 A * 9/1962 Perrucci ..... 124/24.1
3,156,230 A * 11/1964 Groves ..... 124/23.1
3,527,196 A * 9/1970 Karbo ..... 124/24.1
3,537,439 A * 11/1970 Joslin ..... 124/24.1
3,738,348 A * 6/1973 Karbo ..... 124/23.1
3,771,508 A * 11/1973 Black et al. ..... 124/24.1
4,076,005 A * 2/1978 Hill ..... 124/25.6
5,099,819 A * 3/1992 Simonds et al. ..... 124/23.1
5,291,874 A * 3/1994 Harrison ..... 124/23.1
5,335,644 A * 8/1994 Smith et al. ..... 124/23.1
5,365,650 A * 11/1994 Smith et al. ..... 29/417
5,546,923 A * 8/1996 Duncan ..... 124/23.1
5,570,675 A * 11/1996 Treadway ..... 124/23.1
6,019,097 A * 2/2000 Cox et al. ..... 124/23.1
6,055,973 A * 5/2000 Gomez et al. ..... 124/23.1
6,253,752 B1 * 7/2001 Cox et al. ..... 124/23.1
7,258,113 B2 * 8/2007 Pilpel et al. ..... 124/23.1
7,273,575 B2 * 9/2007 Andrews et al. ..... 264/257
7,293,936 B1 * 11/2007 Warren ..... 403/296
7,308,890 B1 * 12/2007 Wheeler ..... 124/23.1
8,079,353 B2 * 12/2011 Davis et al. ..... 124/23.1
8,425,820 B2 * 4/2013 Pilpel ..... 264/162

* cited by examiner

*Primary Examiner* — Gene Kim
*Assistant Examiner* — Alexander Niconovich
(74) *Attorney, Agent, or Firm* — C. G. Mersereau; Nikolai & Mersereau, P.A.

(57) ABSTRACT

A riser of a compound bow includes a lower section and an upper section. The upper section has an end section and a connection section which is connected to the lower section by engagement of pins and pin holes of the two respective connection ends. The connection is further reinforced by way of welding. The end section is further connected with the connection section by engagement of pins and pin holes of the two respective connection ends. The connection is further reinforced by way of welding. The riser is strong and saves material.

8 Claims, 10 Drawing Sheets

RISER OF COMPOUND BOW

BACKGROUND OF THE INVENTION

1. Field of the Invention

The present invention relates to a compound bow, and more particularly, to a riser of a compound bow and which has better strength and saves material.

2. Description of the Prior Art

Archery is a popular exercise and generally comprises a bow which is equipped with a bowstring and the archer nocks the arrow and draws the bowstring so that the two limbs of the bow are bent to store energy. When releasing the bowstring, the arrow is delivered toward the target by the energy stored by the bowstring.

FIG. 1 shows the conventional riser 10 of a compound bow which has a curvature and a protrusion 11 extends from the central portion of the riser 10 so as to define the riser 10 into the upper section 12 and the lower section 13. Each of the upper and lower sections 12, 13 has a limb fixture 14 so that the two limb fixtures 14 are connected with two limbs. In order to reduce the weight of the riser 10, holes 15 are defined through the upper and lower sections 12, 13. Generally, the riser 10 is made by aluminum alloy which is made by either casing or CNC machining. However, the mold set for the casting is expensive, and the respective thickness of the protrusion 11, the upper section 12, the lower section 13 and the limb fixtures 14 are different from each other. The way of CNC machining wastes a lot of material and increase the manufacturing cost.

The present invention intends to provide a riser which saves material and the strength is maintained.

SUMMARY OF THE INVENTION

The present invention relates to a riser of a compound bow and comprises a lower section having a first limb fixture, a first connection portion and a grip. The first limb fixture and the first connection portion are respectively located on two ends of the lower section. The first limb fixture is connected with a limb, and multiple first pins extend from the first connection portion. The grip is located adjacent to the first connection portion. An upper section has an end section and a connection section. A second limb fixture and a second connection portion are connected to two ends of the end section. The second limb fixture is connected with another limb, and multiple second pins extend from the second connection portion. A first connection end and a second connection end are respectively connected to two ends of the connection section. The first connection end has multiple first pin holes in which the first pins are inserted so as to connect the first connection portion to the first connection end. The second connection end has multiple second pin holes in which the second pins are inserted so as to connect the second connection portion to the second connection end. The first connection portion is further welded to the first connection end, and the second connection portion is further welded to the second connection end 226.

The primary object of the present invention is to provide a riser of a compound bow and the riser comprises a lower section, an end section and a connection section, so that the three parts are individually manufactured to have even thickness and save material.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
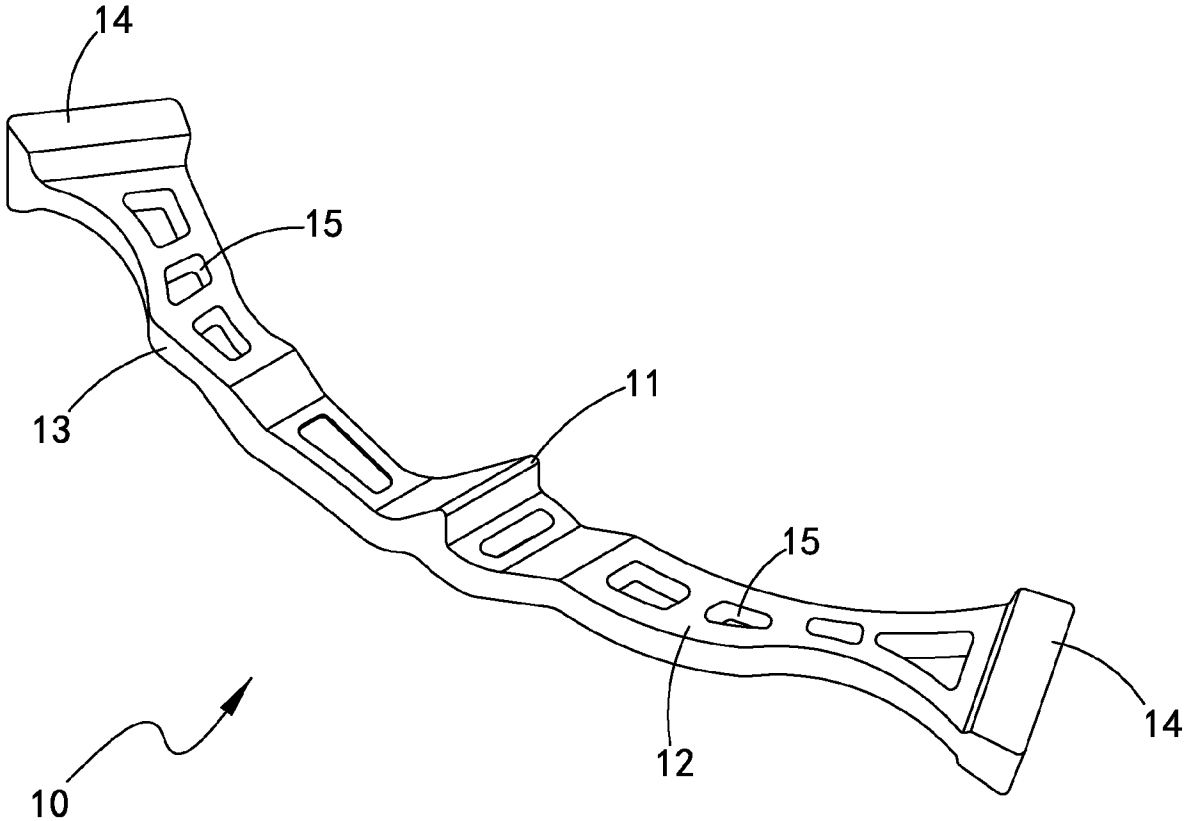
FIG.1 PRIOR ART
FIG. 1 is a perspective view to show the conventional riser of a compound bow.
Figure 2:
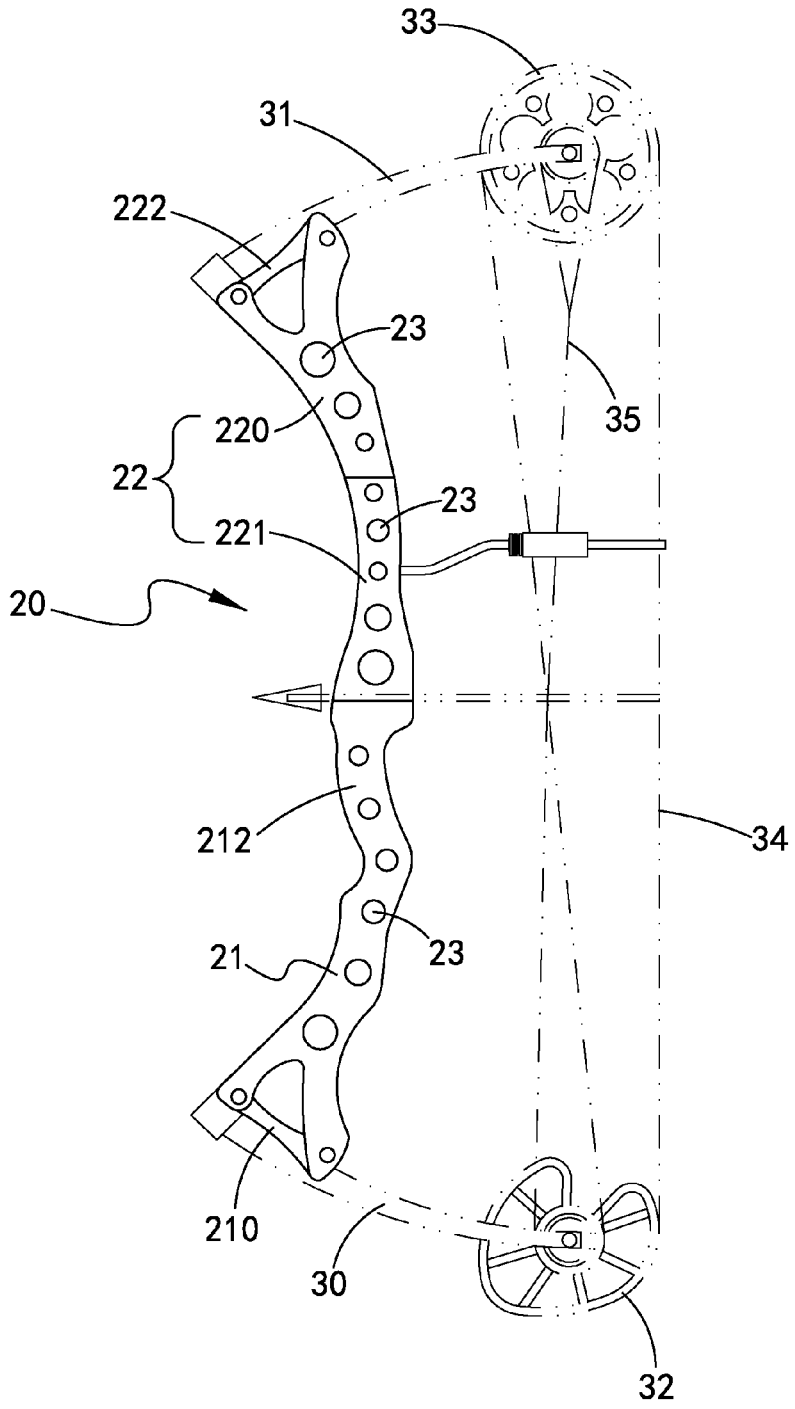
FIG. 2 shows the compound bow with the riser of the present invention.
Figure 3:
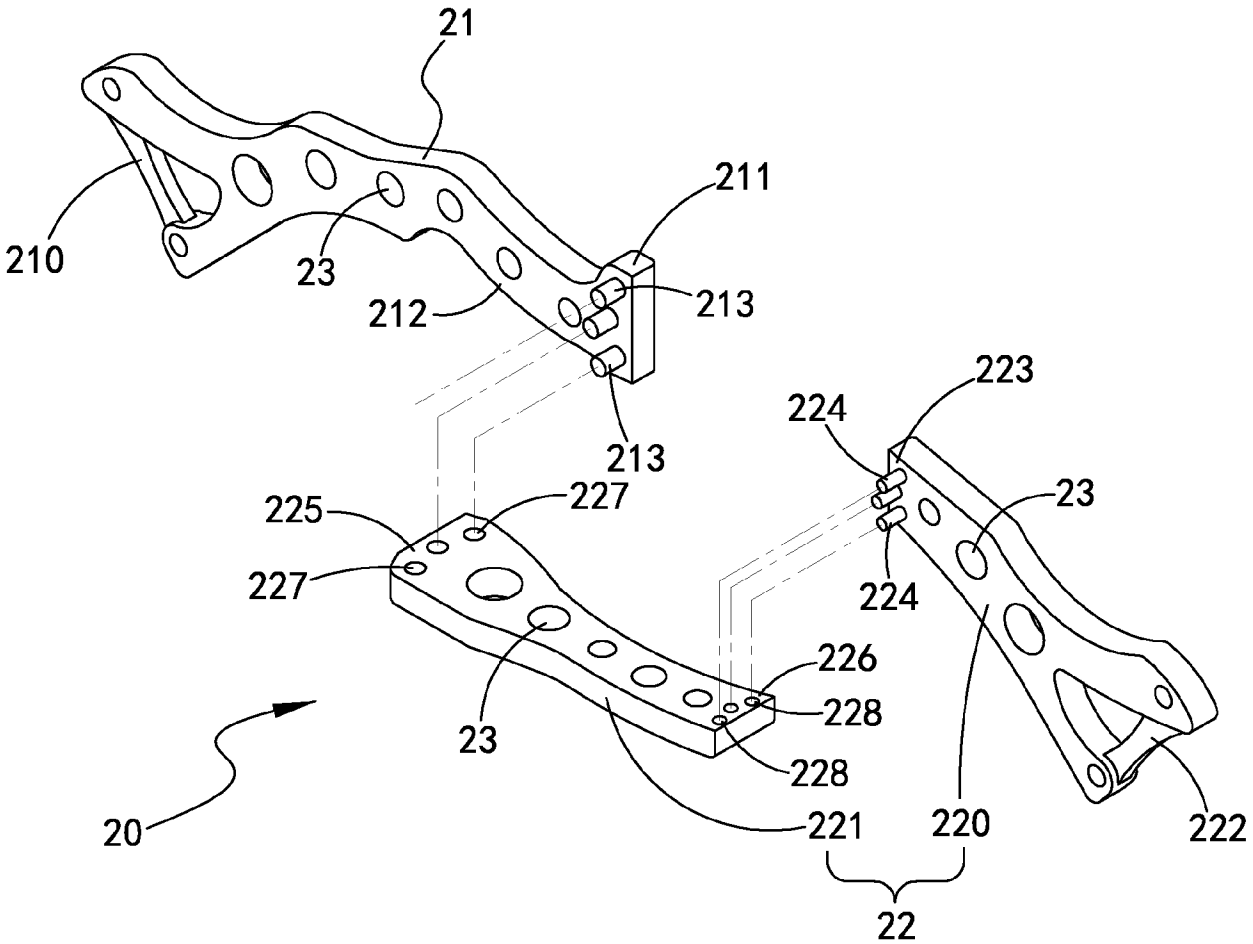
FIG. 3 is an exploded view to show the riser of the present invention.
Figure 4:
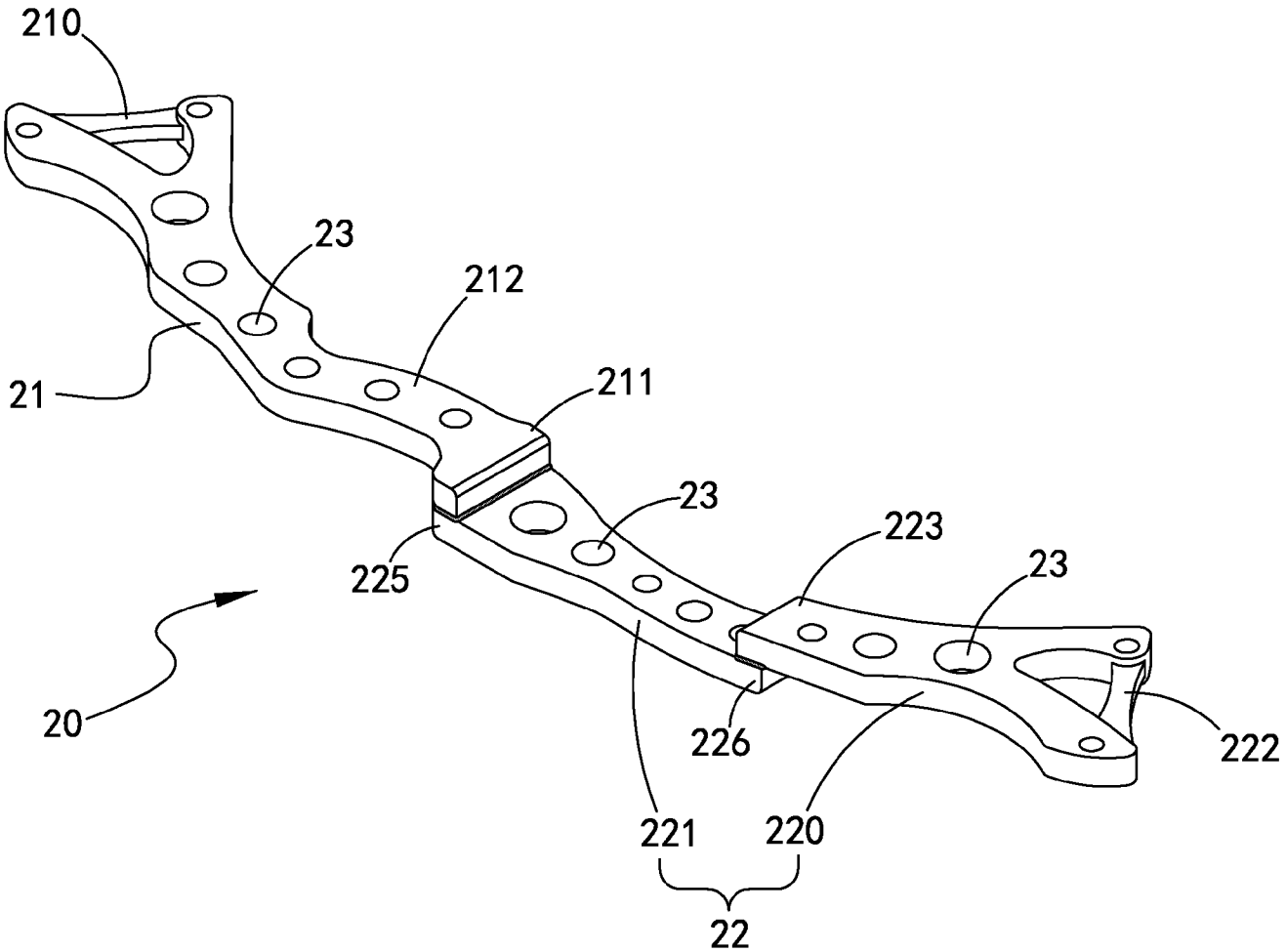
FIG. 4 is a perspective view to show the riser of the present invention.

Referring to FIGS. 2 to 4, the riser 20 of the present invention of a compound bow comprises a lower section 21 and an upper section 22.

The lower section 21 has a first limb fixture 210, a first connection portion 211 and a grip 212. The first limb fixture 210 and the first connection portion 211 are respectively located on two ends of the lower section 21. The first limb fixture 210 is connected with a limb 30. Multiple first pins 213 extend from the first connection portion 211. The grip 212 is located adjacent to the first connection portion 211.

The upper section 22 has an end section 220 and a connection section 221. A second limb fixture 222 and a second connection portion 223 are connected to two ends of the end section 220. The second limb fixture 222 is connected with another limb 31. Multiple second pins 224 extend from the second connection portion 223. A first connection end 225 and a second connection end 226 respectively connected to two ends of the connection section 221. The first connection end 225 has multiple first pin holes 227 in which the first pins 213 are inserted so as to connect the first connection portion 211 to the first connection end 225. The second connection end 226 has multiple second pin holes 228 in which the second pins 224 are inserted so as to connect the second connection portion 223 to the second connection end 226. The first connection portion 211 is further welded to the first connection end 225, and the second connection portion 223 further welded to the second connection end 226.

The lower section 21, the end section 220 and the connection section 221 are made by way of milling from a aluminum alloy block. In order to reduce the weight, the lower section 21, the end section 220 and the connection section 221 has multiple through holes 23 defined therethrough.

The two limbs 30, 31 are respectively connected to the first and second limb fixtures 210, 222. The first limb 30 has an eccentric cam 32 connected thereto and the second limb 31 has a pulley 33 connected thereto. A main bowstring 34 and a sub bowstring 35 are connected between the eccentric cam 32 and the pulley 33.

Figure 5:
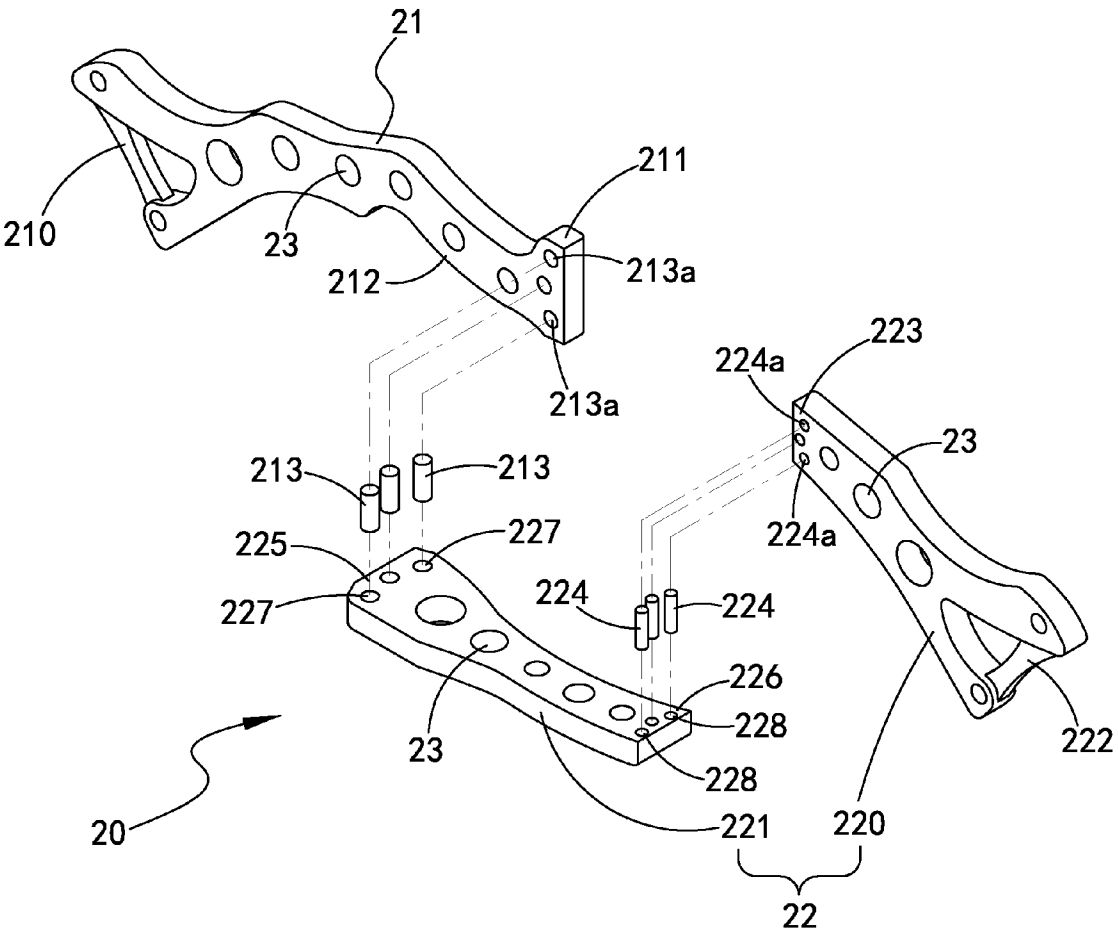
FIG. 5 is an exploded view to show another combination of the riser of the present invention.

As shown in FIG. 5 which shows another combination of the first connection portion 211 and the first connection end 225, and the second connection portion 223 and the second connection end 226. The combination is similar to the previous embodiment, the difference is that the first connection portion 211 has multiple first holes 213*a* in which the first pins 213 are inserted, and the second connection portion 223 has multiple second holes 224*a* in which the second pins 224 are inserted.

Figure 6:
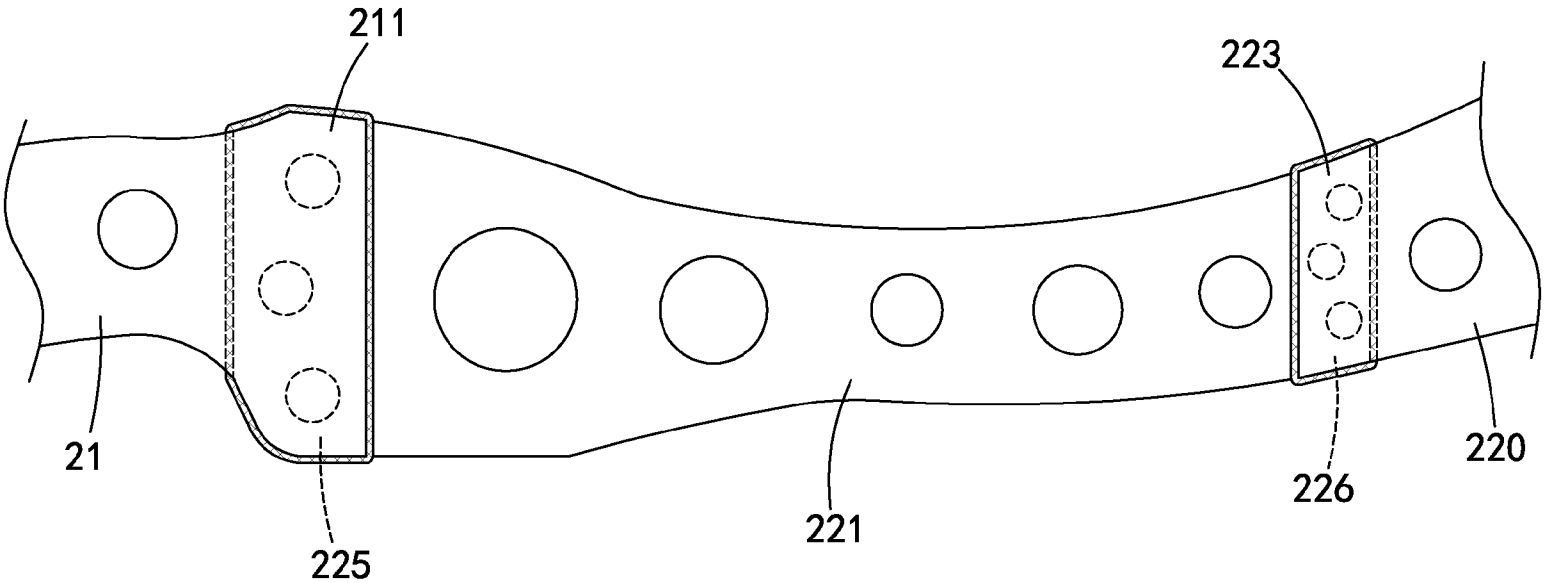
FIG. 6 shows the first welding way for the riser of the present invention.

As shown in FIG. 6, the first connection portion 211 is continuously welded along the periphery of the portion that is connected to the first connection end 225. The second connection portion 223 is continuously welded along the periphery of the portion that is connected to the second connection end 226.

Figure 7:
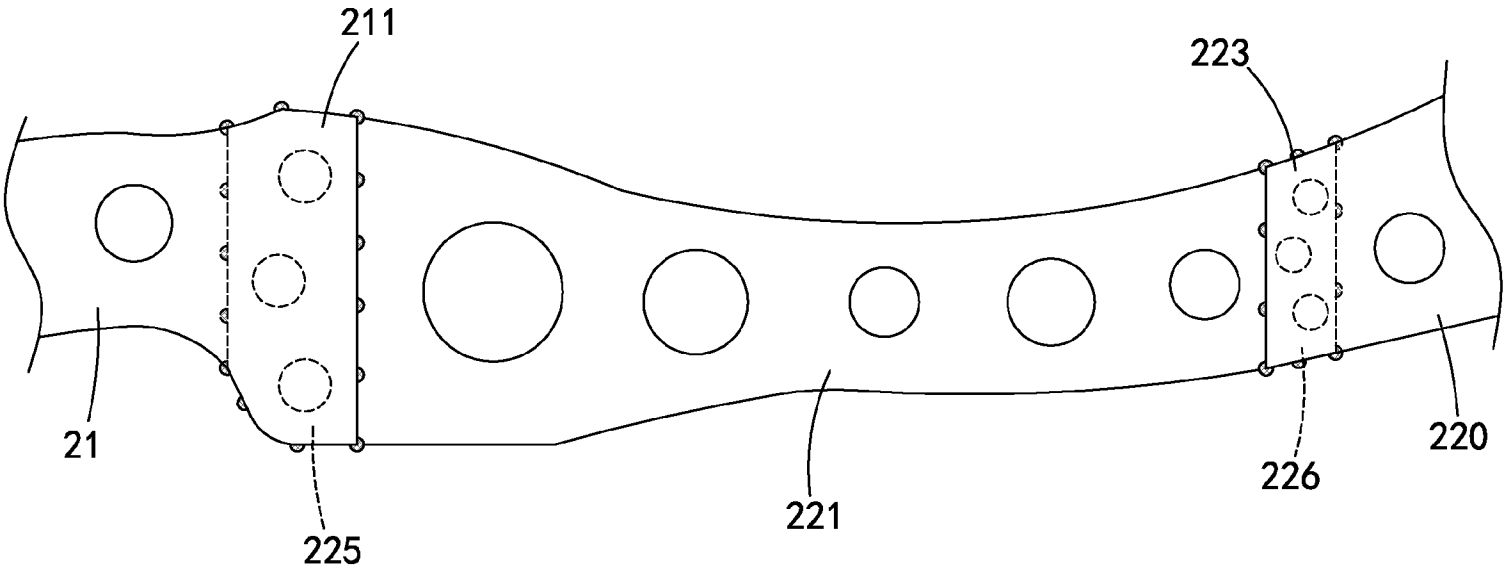
FIG. 7 shows the second welding way for the riser of the present invention.

FIG. 7 shows that the first connection portion 211 is spot welded along the periphery of the portion that is connected to the first connection end 225, and the second connection portion 223 is spot welded along the periphery of the portion that is connected to the second connection end 226.

Figure 8:
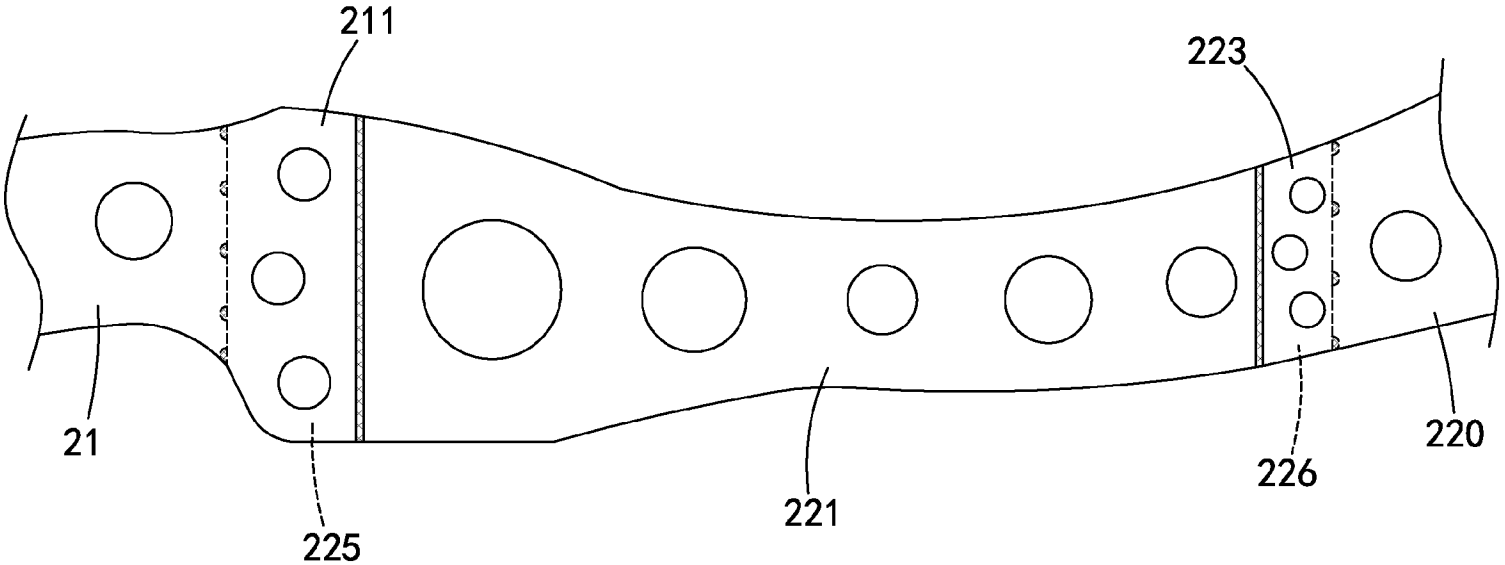
FIG. 8 shows the third welding way for the riser of the present invention.

FIG. 8 shows that the end face of the first connection portion 211 is continuously welded along one side of the first connection end 225, and the end face of the first connection end 225 is spot welded to one side of the first connection portion 211. The end face of the second connection portion 223 is continuously welded along one side of the second connection end 226, and the end face of the second connection end 226 is spot welded to one side of the second connection portion 223. The method of continuous welding is taken because that position is easily to be accessed, and spot welding is taken because that position is not easily to be accessed.

The riser 20 is composed of the lower section 21, the end section 220 and the connection section 221, the three parts are made by way of milling individually, so that the thickness is even so that only very limited material is wasted. The welding does not waste any material. By the engagement between the first pin holes 227 and the first pins 213, the first connection portion 211 is easily connected to the first connection end 225. By the engagement between second pin holes 228 and the second pins 224, the second connection portion 223 is easily connected to the second connection end 226. Furthermore, by the welding processes, the connection between the first connection portion 211 and the first connection end 225, and between the second connection portion 223 and the second connection end 226 are strong.

Figure 9:
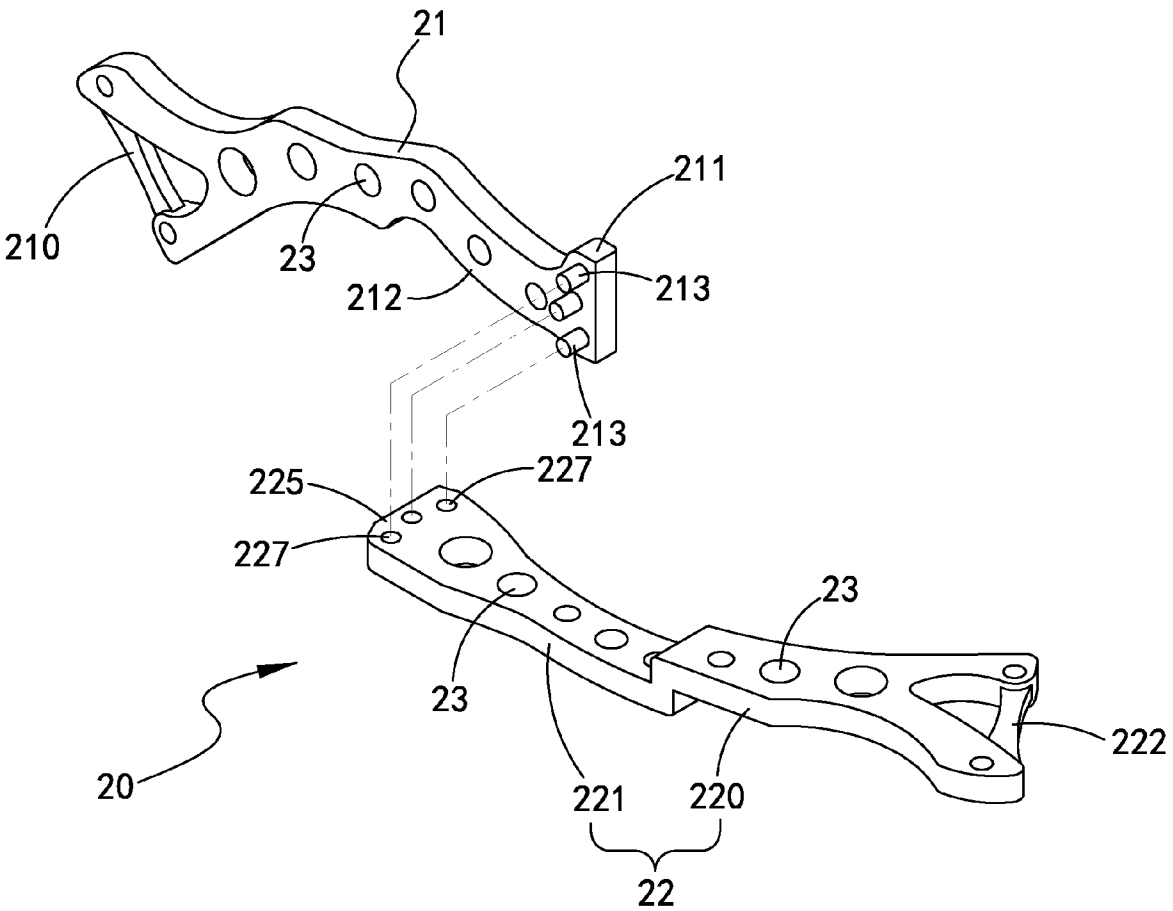
FIG. 9 is an exploded view to show the second embodiment of the riser of the present invention.
Figure 10:
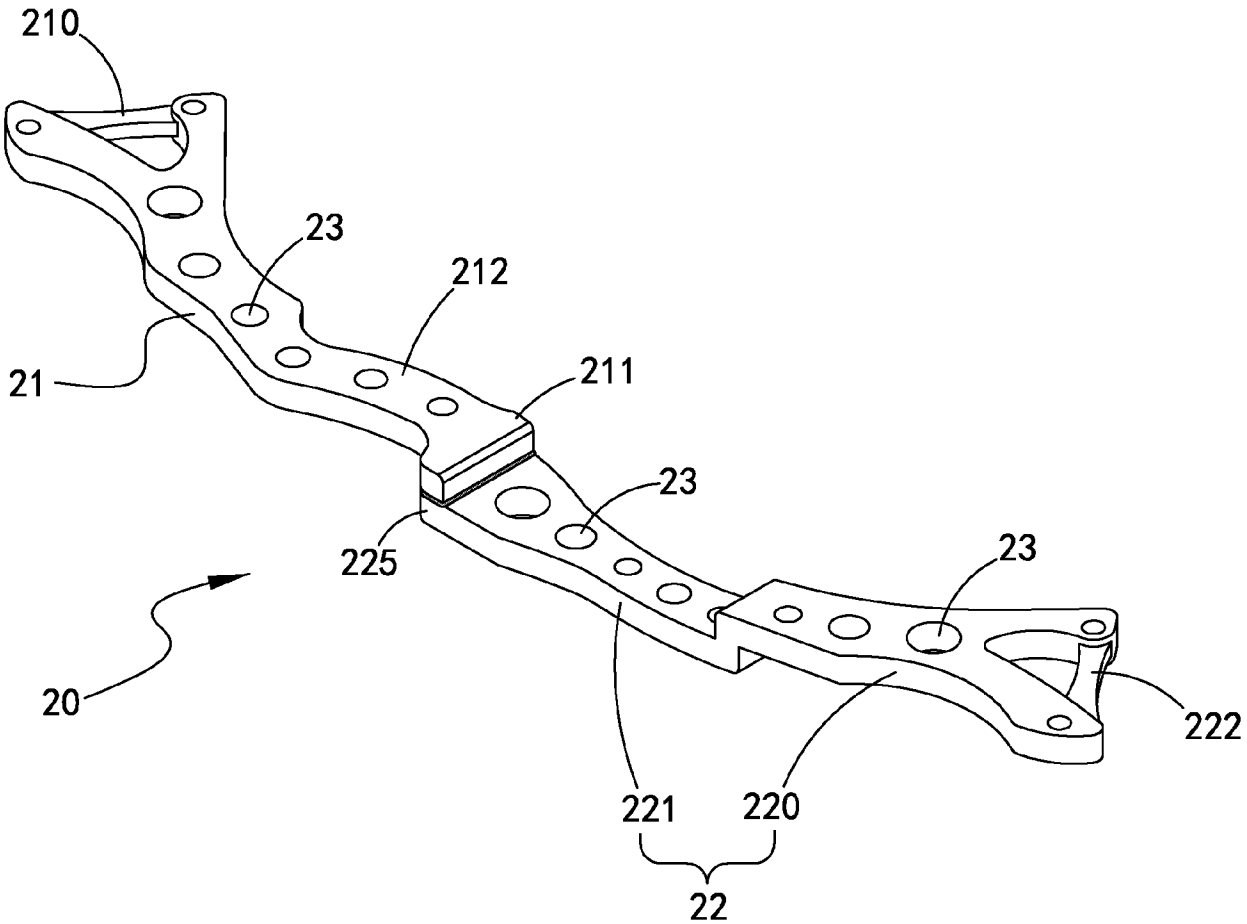
FIG. 10 is a perspective view to show the riser of the second embodiment of the present invention.

FIGS. 9 and 10 show the second embodiment, wherein the end section 220 and the connection section 221 are integrally formed with each other, so that the upper section 22 is ready to be combined with the lower section 21.

While we have shown and described the embodiment in accordance with the present invention, it should be clear to those skilled in the art that further embodiments may be made without departing from the scope of the present invention.

What is claimed is:

1. A riser of a compound bow, comprising:

a lower section having a first limb fixture, a first connection portion and a grip, the first limb fixture and the first connection portion respectively located on two ends of the lower section, the first limb fixture adapted to be connected with a limb, multiple first pins extending from the first connection portion, the grip located adjacent to the first connection portion;

an upper section having an end section and a connection section, a second limb fixture and a second connection portion connected to two ends of the end section, the second limb fixture adapted to be connected with another limb, multiple second pins extending from the second connection portion, a first connection end and a second connection end respectively connected to two ends of the connection section, the first connection end having multiple first pin holes in which the first pins are inserted so as to connect the first connection portion to the first connection end, the second connection end having multiple second pin holes in which the second pins are inserted so as to connect the second connection portion to the second connection end, and the first connection portion being further welded to the first connection end, the second connection portion being further welded to the second connection end.

2. The riser as claimed in claim 1, wherein the first connection portion has multiple first holes in which the first pins are inserted, the second connection portion has multiple second holes in which the second pins are inserted.

3. The riser as claimed in claim 1, wherein the end section and the connection section are integrally formed with each other.

4. The riser as claimed in claim 1, wherein the first connection portion is continuously welded along a periphery of a portion that is connected to the first connection end, the second connection portion is continuously welded along a periphery of a portion that is connected to the second connection end.

5. The riser as claimed in claim 1, wherein the first connection portion is spot welded along a periphery of a portion that is connected to the first connection end, the second connection portion is spot welded along a periphery of a portion that is connected to the second connection end.

6. The riser as claimed in claim 1, wherein the first connection portion is continuously welded along a half of a periphery of a portion that is connected to the first connection end, the other half of the periphery of the portion of the first connection portion that is connected to the first connection end is spot welded, the second connection portion is continuously welded along a half of a periphery of a portion that is connected to the second connection end, the other half of the periphery of the portion of the second connection portion that is connected to the second connection end is spot welded.

7. The riser as claimed in claim 1, wherein an end face of the first connection portion is continuously welded along one side of the first connection end, an end face of the first connection end is spot welded to one side of the first connection portion, an end face of the second connection portion is continuously welded along one side of the second connection end, an end face of the second connection end is spot welded to one side of the second connection portion.

8. The riser as claimed in claim 1, wherein the lower section, the end section and the connection section has multiple through holes defined therethrough.

* * * * *